US005873711A

United States Patent [19]

Lifson

[11] Patent Number: 5,873,711

[45] Date of Patent: Feb. 23, 1999

[54] SCROLL COMPRESSOR WITH REDUCED SEPARATING FORCE BETWEEN FIXED AND ORBITING SCROLL MEMBERS

[75] Inventor: Alexander Lifson, Manlius, N.Y.

[73] Assignee: Carrier Corporation, Farmington, Conn.

[21] Appl. No.: 56,476

[22] Filed: Apr. 7, 1998

Related U.S. Application Data

[63] Continuation of Ser. No. 739,578, Oct. 30, 1996.

[51] Int. Cl.[6] ..... F04C 18/04

[52] U.S. Cl. ..... 418/55.2; 418/55.5; 418/57

[58] Field of Search ..... 418/1, 55.2, 55.4, 418/55.5, 57

[56] References Cited

U.S. PATENT DOCUMENTS

| | | | |
|---|---|---|---|
| 4,204,816 | 5/1980 | Bein | 418/55.2 |
| 4,437,820 | 3/1984 | Terauchi et al. | 418/55.4 |
| 4,600,369 | 7/1986 | Blain | 418/57 |
| 4,859,159 | 8/1989 | Leptein | 418/55.2 |
| 5,035,589 | 7/1991 | Fraser, Jr. et al. | 418/55.2 |
| 5,421,707 | 6/1995 | Daniels | 418/55.2 |

FOREIGN PATENT DOCUMENTS

| | | | |
|---|---|---|---|
| 0065261 | 11/1982 | European Pat. Off. . | |
| 1227886 | 9/1989 | Japan | 418/55.2 |
| 08028482 | 1/1996 | Japan . | |

*Primary Examiner*—John J. Vrablik
*Attorney, Agent, or Firm*—Howard & Howard

[57] ABSTRACT

A scroll compressor has structure in the tips of at least one of its wraps that reduces a force separating the scroll wraps. In one embodiment, the structure includes recesses formed in the tip such that low pressure fluid is tapped across the surface between the tip and the opposed scroll base. The low pressure fluid reduces the separating force between the scroll wrap. Separating walls may be formed to define separate recesses. In a second embodiment, an intermediate pressure fluid is tapped into a groove. Again, the low pressure reduces the separating force component across the scroll wrap. This invention is particularly valuable in the type of scroll wraps having thick wraps.

6 Claims, 3 Drawing Sheets

SCROLL COMPRESSOR WITH REDUCED SEPARATING FORCE BETWEEN FIXED AND ORBITING SCROLL MEMBERS

This is a continuation of U.S. patent application Ser. No. 08/739,578 filed Oct. 30, 1996.

BACKGROUND OF THE INVENTION

This invention relates to a structure for minimizing separating pressure in a scroll compressor by tapping an intermediate suction pressure to the tip of at least one of the scroll members.

Scroll compressors are becoming widely accepted in the HVAC and refrigeration industries. Scroll compressors are relatively inexpensive, and typically more efficient and less noisy than reciprocating compressor counterparts. Scroll compressor technology has advanced greatly over the past several years. However, scroll compressor design still presents challenges in achieving reliable operation over a broad range of suction and discharge conditions. One major challenge is the reduction of the separating force between the orbiting and fixed scroll members.

FIG. 1 is a view of a known scroll compressor 20. An orbiting scroll 22 is driven through a shaft 24 to move relative to a fixed scroll 26 and compress a fluid captured between orbiting scroll 22 and fixed scroll 26. Fixed scroll 26 has a scroll wrap 28 and the orbiting scroll has a scroll wrap 27. As known, the two scroll wraps contact each other at several points along the flanks, as well as opposing baseplates, that defines compression chambers between fixed and orbiting scroll wraps.

Refrigerant captured between orbiting scroll 22 and fixed scroll 26 creates a separating force tending to move the two scroll members away from each other. It is desirable to maintain the two scroll members in contact with each other to minimize leakage and avoid instability. When a scroll compressor becomes instable, the orbiting scroll is not in equilibrium. Instead, it may pivot or overturn until it comes in contact with another mechanical element. This action, coupled with the orbital movement of the orbiting scroll results in a sort of wobbling motion with axial contact occurring along the edge of the part. This wobbling, or instability, results in leakage through the gaps opened by the separated tips, edge loading of the scroll surfaces, and angular misalignment of the scroll drive bearing. All of these could quickly lead to loss of performance and premature failure of the compressor.

In effect, the separating force tries to push orbiting scroll 22 away from the fixed scroll 26. To combat this separating force, a back pressure chamber 29 is created between two sealing elements 30 and 32 mounted in a crankcase 33 which is also fixed to the fixed scroll 26. Back pressure chamber 29 receives fluid from a tap, such as tap 34. The aspects of compressor 20 described to this point are as known in the art and form no portion of this invention.

However, the back chamber force is limited in magnitude, because of space limitations on the back chamber area and maximum achievable back chamber pressure. Essentially, the force in back pressure chamber 29 must overcome the separating force and press orbiting scroll 22 upwardly against fixed scroll, as well as be high enough to avoid orbiting scroll instability. The problem becomes most pronounced for refrigeration applications, with a broad range of operating pressures. Thus, it would be most desirable to reduce the separating force to minimize the restrictions on the compressor operating range.

The separating force across a portion of the scroll is shown graphically in FIG. 2. The dotted line 28 shows the location over the tip portion of scroll wrap. As is known, a higher pressure is applied on one side of wrap 28 and a lower pressure exists on the opposed side. The separating force is created by the pressure multiplied by the area over which the pressure is applied.

The present invention is directed to reducing the component of separating force applied across the scroll wrap tip. There is a pressure transition or gradient 35 across the tip of scroll wrap 28. The transition can be estimated by assuming a straight slope between the high pressure to the low pressure across the width of the wrap. While this estimation may not always be accurate, it is generally a good approximation. In practice, however, there are some variations and the pressure gradient is not always a constant slope. The problem to be solved by this invention will be explained by reference to the constant pressure slope shown in FIG. 2. However, it should be understood that the slope may be a curve or other irregular shape. The problem to be solved would still exist.

As shown in FIG. 2, there is changing pressure shown by cross-hatching beneath gradient 35 across the width of scroll wrap 28. This pressure multiplied by the area it covers contributes a portion of the separating force. Originally, scroll wraps were thin and of constant width. The separating force component across the scroll wrap tips was relatively small in this type of prior art systems, since the area of the scroll wrap was relatively small.

However, more recently, varying width scroll wraps have been developed such as shown in FIG. 1. These varying width scroll wraps have some relatively wide locations. At the wide locations, the separating force component over the scroll wrap tips becomes significant, and as such it becomes beneficial to reduce it for the reasons mentioned above.

SUMMARY OF THE INVENTION

A disclosed embodiment of this invention minimizes the separating force component created by pressure across the scroll wrap tips. In embodiments of this invention, low pressure fluid is tapped to a location between the scroll wrap tip and the opposed scroll plate. In this way, the scroll wrap sees only low pressure for the majority of its width. The high to low pressure gradient only occurs over a relatively small portion of the wrap width. Thus, the total component of the separating force due to the scroll wrap width is greatly reduced. The present invention is particularly beneficial in refrigeration applications, where separating force and overturning moments are high.

One embodiment for achieving this invention utilizes shallow recesses extending axially into the scroll wrap. The recesses extend to the low pressure side of the scroll wrap and tap low pressure fluid into the space created by recesses on tip of scroll wrap. The high to low pressure gradient does not essentially begin until a location past the recess. The present invention thus reduces the high to low pressure gradient to a smaller portion of the wraps. The remainder portion of the scroll wrap is maintained at the low pressure. Thus, the total separating force component due to pressure on the scroll wrap tip is greatly reduced. This invention has particular beneficial application in the type of scroll wrap having a wide width, which occurs in scroll wraps of varying width.

In preferred features of this embodiment, the recesses are separated from each other. This feature minimizes the likelihood of leakage along the scroll wrap in a circumferential direction from the high pressure side to the low pressure side. In preferred features of this invention, the depth of the recess is less than 200 microns. More preferably, the depth of the recesses is 20 microns or less. To ease manufacturing, the series of recesses can be replaced by one continuous recess.

In a second embodiment of this invention, the intermediate pressure fluid is tapped into grooves or series of grooves, formed on the scroll wrap tip. A tap to the low pressure fluid communicates into the groove. The scroll wrap tip will see a low pressure between the groove and extending outwardly toward the low pressure side of the scroll. The high to the low pressure gradient will occur from the groove to the side discharge pressure of the wrap. Since the gradient occurs over a relatively small portion of the width, the total separating force component from that gradient is reduced.

In features of this embodiment, the groove may be relatively shallow, and of the same or larger depth as the recesses discussed above. Pressure taps communicate with the low pressure side of the scroll wrap to cap fluid to the groove. Also the groove may be separated into multiple grooves each communicating with a pressure tap.

In preferred features of this embodiment, the taps are made in a form of a recess located on the scroll wrap tip. To further reduce pressure in the groove the recess can be machined at an angle and connected to the groove at the location closest to the low pressure.

These and other features of the present invention can be best understood from the following specification and drawings, of which the following is a brief description.

DETAILED DESCRIPTION OF A PREFERRED EMBODIMENT

Figure 3:
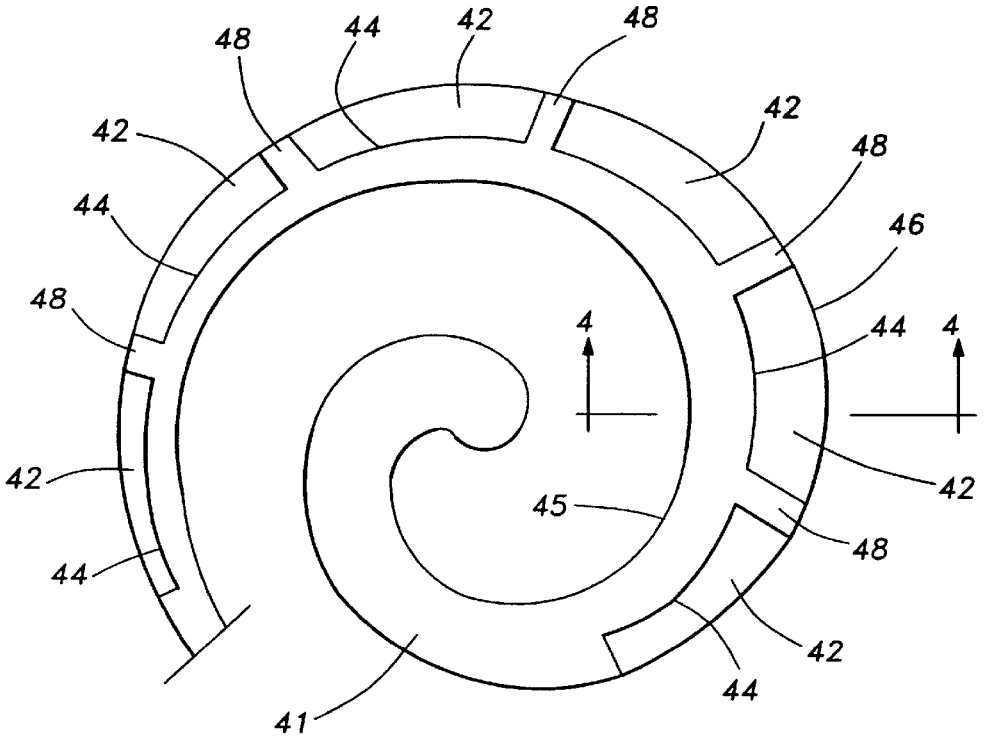
FIG. 3 shows a first embodiment of the present invention.

FIG. 3 shows a scroll wrap 41. While the scroll wrap 41 may represent either the orbiting or fixed scroll wrap, in a most preferred embodiment, at least the fixed scroll wrap is provided with the inventive structure, since often it is thicker than the orbiting scroll. Shallow recesses 42 are formed on the tip of the fixed or non-orbiting scroll wrap 41. The shallow recesses 42 extend to an inner wall 44, adjacent to the high pressure side 45 of the scroll wrap 41. Recesses 42 extend to the low pressure side 46 of the scroll wrap 41. Thus, low pressure fluid from side 46 moves into recesses 42 and to wall 44. Separating walls 48 are formed between the recesses 42. The separating walls 48 define discrete recesses, which reduce leakage along the scroll wrap 41 in a circumferential direction.

Figure 4:
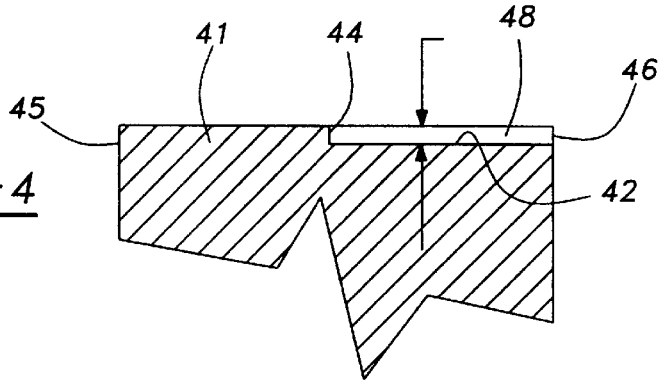
FIG. 4 is a cross section along line 4—4 as shown in FIG. 3.

As shown in FIG. 4, the recess 42 extends from edge 46 to wall 44, and at a location spaced from side 45. Separating walls 48 extend intermediate adjacent recesses 42. The recesses 42 in total extend along the circumferential length of the wrap. For ease of manufacturing, the same objective can be achieved with one single recess, however, additional leakage along the scroll wrap may occur.

The recesses 42 are shallow, and the depth as shown in FIG. 4 is greatly exaggerated for illustration purposes. The recess is preferably of a depth less than 200 microns, for a scroll wrap typically having an axial height of at least 0.5 inch and up to several inches. More preferably, the recess has a depth of 20 microns or less. The depth does not have to be uniform and can be tapering off towards the high pressure side.

When operating the scroll compressor with a scroll wrap 41 for either the fixed or orbiting scroll, the overall separating force is reduced, as will now be explained below.

Figure 1:
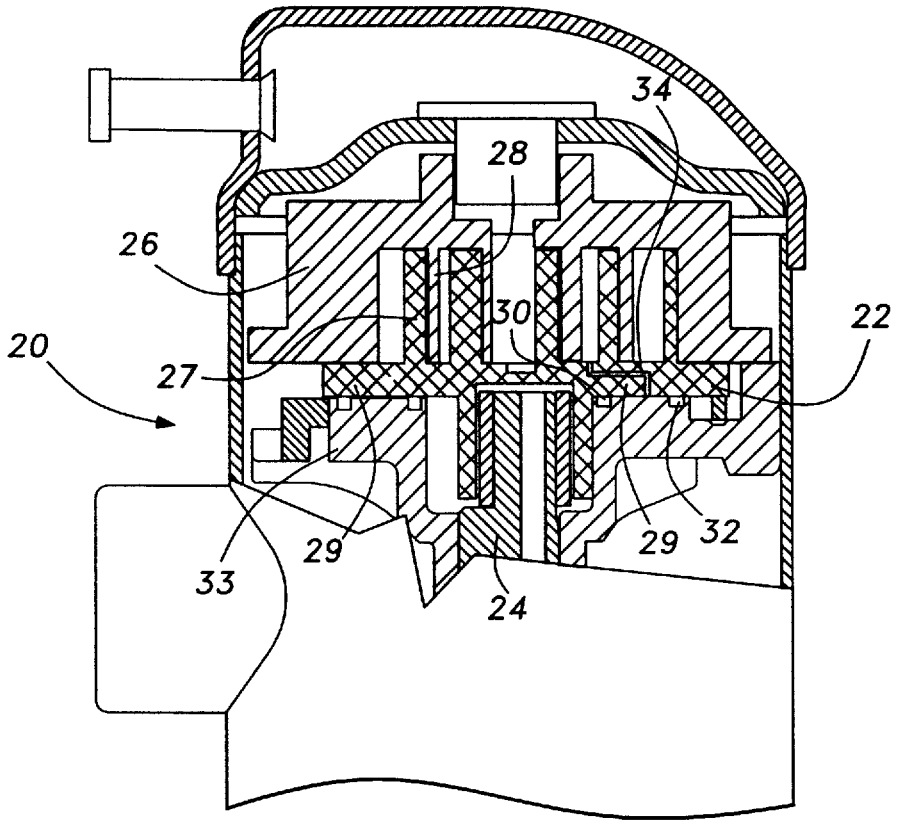
Fig-1 Prior Art
FIG. 1 is a view of a prior art scroll compressor.
Figure 2:
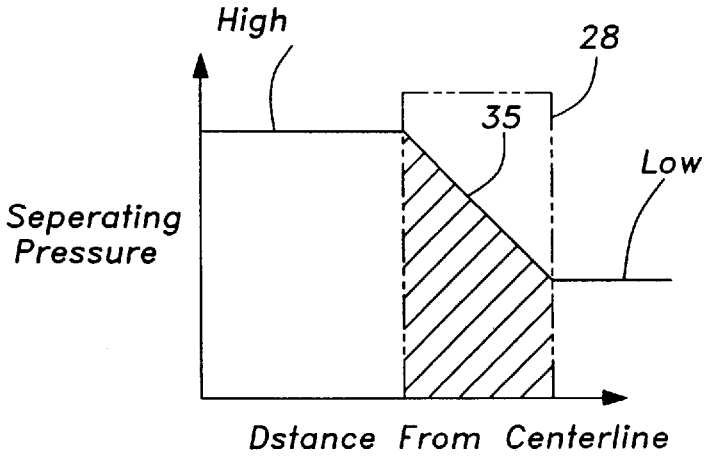
Fig-2 Prior Art
FIG. 2 shows limitations with the prior art scroll compressor.
Figure 5:
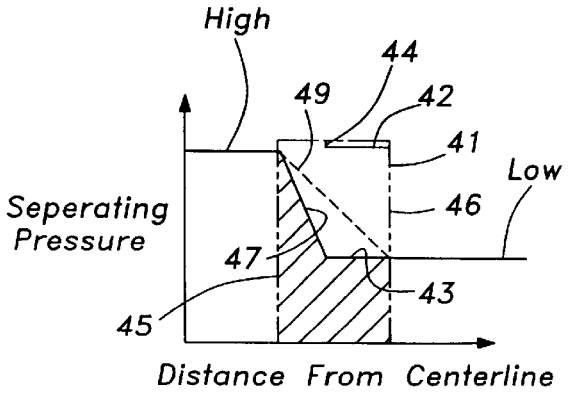
FIG. 5 graphically shows the improvement due to the first embodiment.

The benefits from the first embodiment as shown in FIGS. 3 and 4 may be seen in FIG. 5. FIG. 5 is similar to FIG. 2 in that it graphically shows a component of the separating force across a portion of the scroll. The high pressure extends to the outer end 45. A low pressure 43 extends inwardly across the scroll wrap 41 to the wall 44. Between the wall 44 and the outer edge 45, the high pressure to low pressure gradient 47 occurs. The separating force is reduced by minimizing the area over which high pressure is acted upon. A line 49 shows where the gradient would have occurred with the prior art structure. The area covered by the shaded portion below the gradient 47 and line 43 as occurs with this invention is proportional to the separating force component now occurring with the invented scroll wrap. The area covered by the portion between gradient 47, line 43 and gradient 49 is proportional to the reduction in separating force achieved by this embodiment of the invention.

Figure 6:
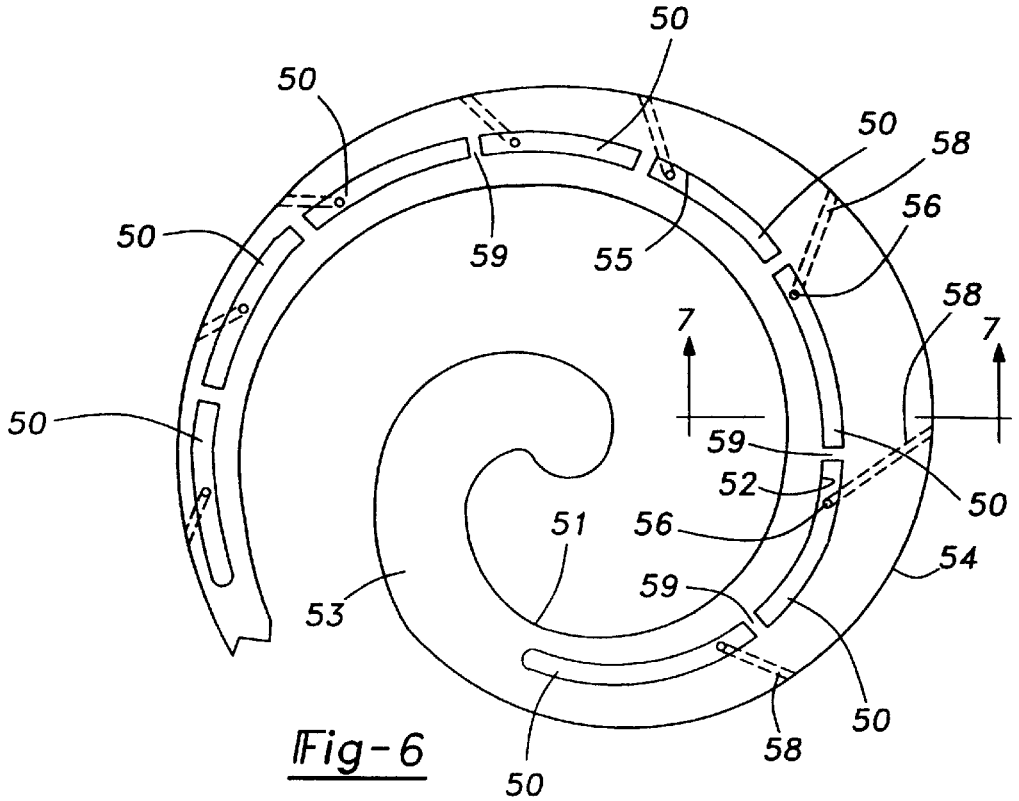
FIG. 6 shows a second embodiment of the present invention.

A second embodiment is shown in FIG. 6 having a scroll wrap 53. Scroll wrap 53 is provided with a groove 50 formed of a number of groove components, at a location spaced toward the discharge pressure side 51 of the wrap 53. The groove 50 extends along the length of wrap 53. As shown, the groove 50 has a wall 52 spaced toward the high pressure side 51. A tap 58 extends from the groove 50 outwardly to the low pressure side 54 of the wrap 53. The groove 50 extends between wall 52 and an outer wall 55. A further tap 56 extends into the wrap 53 and communicates with the tap 58. The low pressure fluid is tapped into the grooves 50 through taps 58 and 56. Separating walls 59 are formed in the groove 50, again to minimize leakage. The result is a plurality of discrete groove component portions each having individual taps 56 and 58.

Figure 7:
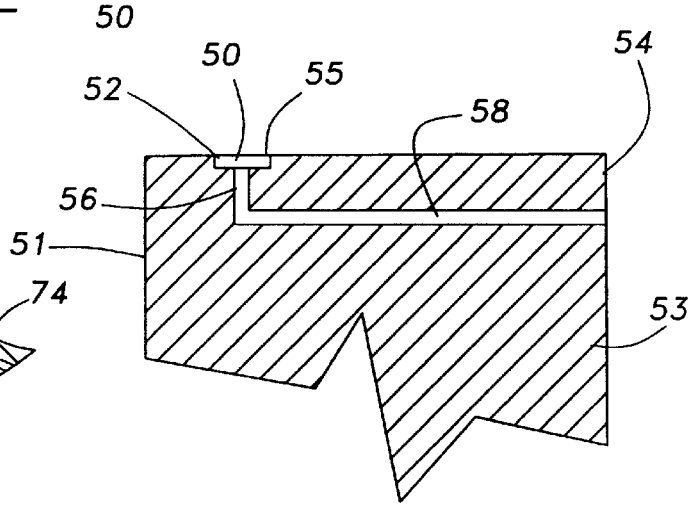
FIG. 7 is a cross sectional view along line 6—6 as shown in FIG. 5.

As shown in FIG. 7, the tap 58 extends outwardly to side 54 of the scroll wrap 49. The groove is preferably angled toward the lower pressure areas, as shown. As also shown, the groove 50 is spaced toward the discharge pressure side 51 of the scroll wrap 53.

Again, by utilizing this structure, the total separating force across scroll wrap 49 is reduced.

Figure 8:
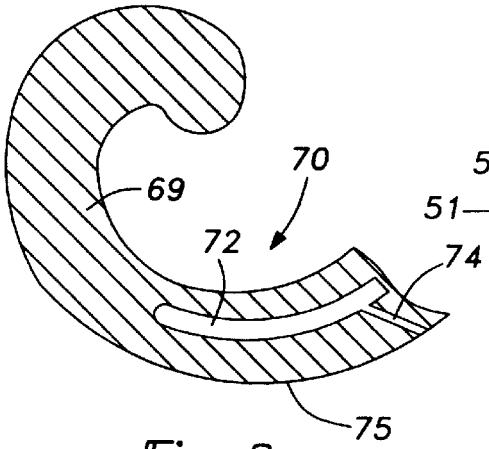
FIG. 8 shows a third embodiment.

FIG. 8 shows a small portion of a wrap 69 in a third embodiment 70 having groove portions 72 like those shown in the FIG. 6 embodiment. Taps 74 are formed in the face of the scroll tip and extend to the outer edge 75. These taps 74 may be angled as were the taps in the FIG. 6 embodiment.

Figure 9:
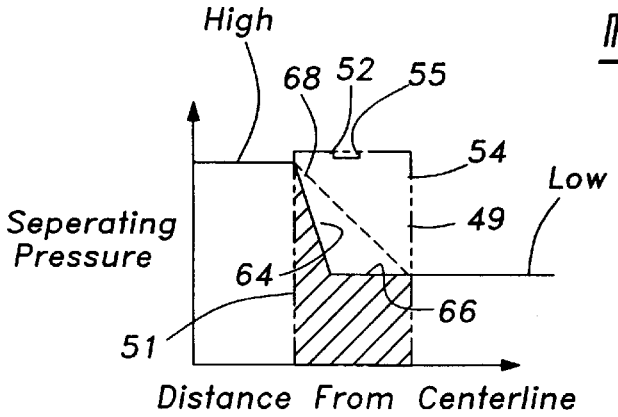
FIG. 9 graphically shows the improvement due to the second and third embodiment.

The benefits from the second embodiment shown in FIGS. 6 and 7 and the embodiments of FIG. 8 are illustrated graphically in FIG. 9. As shown in FIG. 8, the discharge pressure gradient 64 occurs between the wall 51 and the wall 52 of the groove 50. Across the groove 50 and to the intermediate pressure side 54 of the wrap 49 all pressure is low pressure, as shown by line 66. The prior art would have achieved a high to low pressure gradient 68. The area between the gradient 64, line 66 and gradient 68 is proportional to reduction of separating force with this embodiment of the invention.

The invention shown in FIGS. 3–6 are particularly valuable for thick scroll wraps. These are the types of scroll wraps as illustrated in the FIGS. 3–6 embodiments. For several reasons, varying width scroll wraps, which have relatively thick sections, have recently been utilized in many applications. In these types of scroll wraps, the separating force across the scroll wrap tips becomes a greater portion of the overall separating force. It is in those applications that this invention is particularly beneficial.

As is clear from the figures, the recesses do not extend for the entire height of the scroll wraps. Further, the embodiments shown in FIGS. 6, 7, and 8 have taps which are of a circumferential width less than the distance of the groove, and which extend in a direction which is non-parallel to the direction of the groove.

Preferred embodiments of this invention have been disclosed, however, a worker of ordinary skill in the art would recognize that certain modifications would come within the scope of this invention. For that reason, the following claims should be studied to determine the true scope and content of this invention.

I claim:

1. A scroll compressor comprising:

a non-orbiting scroll having a scroll wrap extending from a base for a wrap height;

an orbiting scroll having a scroll wrap extending from a base for a wrap height, and intermitting with said non-orbiting scroll wrap, said orbiting scroll being provided with a drive to move it relative to said non-orbiting scroll, said non-orbiting and said orbiting scrolls together defining a plurality of pressure chambers between said orbiting and non-orbiting scroll wraps, higher pressure chambers being defined on a first side of said scroll wraps, and lower pressure chambers defined on a second side of said scroll wraps and between opposed scroll wraps; and said scroll wraps having tips facing said base of the other of said scroll wraps, said tips of at least one of said non-orbiting and orbiting scrolls being provided with a recess extending into a face of said tip for a depth that is less than said wrap height, said recess reducing the overall separating force between said tip of said at least one of said non-orbiting and orbiting scrolls and said base of the other of said scrolls, said recess extending along said wrap in a first direction, and a tap extending from said recess to said second side to communicate lower pressure to said recess, said tap extending for a circumferential distance that is less than the circumferential distance of said recess, and said tap extending in a direction which is non-parallel to the direction of said recess.

2. A scroll compressor as recited in claim 1, wherein said tap is formed into an outer surface of said tip.

3. A scroll compressor as recited in claim 1, wherein said tap extends from a position in said scroll wrap spaced towards said base from said tip, and extends into said groove.

4. A scroll compressor as recited in claim 1, wherein said groove extends into a face of said tip for a depth less than 200 microns.

5. A scroll compressor comprising:

a non-orbiting scroll having a scroll wrap extending from a base for a wrap height;

an orbiting scroll having a scroll wrap extending from a base for a wrap height, and interfitting with said non-orbiting scroll wrap, said orbiting scroll being provided with a drive to move it relative to said non-orbiting scroll, said non-orbiting and said orbiting scrolls together defining a plurality of pressure chambers between said orbiting and non-orbiting scroll wraps, higher pressure chambers being defined on a first side of said scroll wraps, and lower pressure chambers defined on a second side of said scroll wraps and between opposed scroll wraps; and said scroll wraps having tips facing said base of the other of said scroll wraps, said tips of at least one of said non-orbiting and orbiting scrolls being provided with a recess extending into a face of said tip for a depth that is less than said wrap height, said recess communicating with a tap, said tap extending from said second side of said wrap, and at a location spaced toward said base from said tip, said tap extending through said wrap to communicate fluid from said second side to said recess, said tap extending for a circumferential distance that is less than a circumferential distance of said recess, said tap and said recess together reducing the separating force between said orbiting and non-orbiting scroll by tapping refrigerant from said second side to said recess.

6. A scroll compressor as recited in claim 5, where said recess extending into said wrap for a depth that is less than 200 microns.

* * * * *